US005165753A

United States Patent [19]

Henderson

[11] Patent Number: 5,165,753

[45] Date of Patent: Nov. 24, 1992

[54] ELEVATOR CHAIR APPARATUS

[76] Inventor: Eldred D. Henderson, P.O. Box 444, Calhoun City, Miss. 38916

[21] Appl. No.: 702,088

[22] Filed: May 17, 1991

Related U.S. Application Data

[63] Continuation-in-part of Ser. No. 636,623, Jan. 2, 1991, abandoned.

[51] Int. Cl.[5] ..... A47C 1/02

[52] U.S. Cl. ..... 297/326; 297/327; 297/328; 297/330; 297/DIG. 10

[58] Field of Search ..... 297/326, 346, DIG. 10, 297/327, 328, 330

[56] References Cited

U.S. PATENT DOCUMENTS

| | | | |
|---|---|---|---|
| 1,941,901 | 1/1934 | Knabusch et al. | 297/327 X |
| 3,138,402 | 6/1964 | Heyl, Jr. et al. | 5/83 X |
| 3,147,038 | 9/1964 | Barabas | 297/89 |
| 3,150,898 | 9/1964 | Knudson | 297/346 X |
| 3,250,569 | 5/1966 | Gaffney | 297/330 |
| 3,479,086 | 11/1969 | Sheridan | 297/330 |
| 3,596,991 | 8/1971 | McKee et al. | 297/326 |
| 3,640,566 | 2/1972 | Hodge | 297/68 |
| 3,851,917 | 12/1974 | Horstmann et al. | 297/345 X |
| 3,881,771 | 5/1975 | Amstutz | 297/71 |
| 4,007,960 | 2/1977 | Gaffney | 297/342 X |
| 4,083,599 | 4/1978 | Gaffney | 297/131 |
| 4,453,766 | 6/1984 | DiVito | 297/316 |
| 4,632,455 | 12/1986 | Schiller et al. | 297/326 |
| 4,632,456 | 12/1986 | Kassai | 297/327 X |
| 4,690,457 | 9/1987 | Poncy et al. | 297/337 |
| 4,720,143 | 1/1988 | Schwartz et al. | 297/332 X |

*Primary Examiner*—James R. Brittain
*Assistant Examiner*—Milton Nelson, Jr.
*Attorney, Agent, or Firm*—Pravel, Gambrell, Hewitt, Kimball & Krieger

[57] ABSTRACT

A lift chair or elevator chair apparatus for invalids provides a base portion having an inclined upper surface and a sub-frame pivotally attached thereto along a forward edge. A mechanical ram powered by an electric motor pivots the sub-frame with respect to the base and about the forward pivot. The inclined upper surface of the base receives the sub-frame thereon in a fully downward position which defines a reclined position for the user. Pivotal rotation of the sub-frame with respect to the base and upon the pivot to an uppermost position defines the forward most lifting position which aids the invalid in moving from a sitting to a standing position.

23 Claims, 4 Drawing Sheets

ELEVATOR CHAIR APPARATUS

This is a continuation-in-part application of co-pending U.S. patent application Ser. No. 07/636,623, filed Jan. 2, 1991, abandoned Sept. 26, 1991, and incorporated herein by reference.

BACKGROUND OF THE INVENTION

1. Field of the Invention

The present invention relates to lift chairs and more particularly relates to an improved elevator or "lift" chair apparatus for use by invalids, and wherein the chair has a lower base with a movable portion pivotally attached thereto at a front portion of the base, with an extensible powered operator pivoting the chair with respect to the base at the hinge in order to lift the occupant forwardly and upwardly.

2. General Background

In the care of invalids, elderly, disabled and/or injured persons, there is commonly employed a chair having an occupant assisting feature in the form of a mechanical or electro-mechanical mechanism that powers the chair and/or the back portion of the chair upwardly and forwardly so as to assist the occupant in moving from a sitting to a standing position. Some "lift" chairs use mechanical mechanisms to operate the seat and back portions separately. This type of lift chair apparatus can be seen generally in the Gaffney U.S. Pat. Nos. 3,250,569; 4,007,960; and 4,083,599; as well as the Horstmann U.S. Pat. No. 3,851,917.

The prior art includes a number of mechanical devices in the form of lift chairs, chairs for invalids, reclining elevator chairs and the like. As an example, an early U.S. Pat. No. 3,147,038 issued to Varabas entitled "Reclining Chair" uses an electric motor to recline the back portion of a chair by swinging the chair to and from upright and reclining positions. The mechanism includes a pair of back rails and a sub-frame having portions engaging the outer faces of the rails and movable only in the plane of the rails. The sub-frame has an upholstered portion concealing the rails.

In the Gaffney U.S. Pat. No. 3,250,569 entitled "Elevator Seats" there is provided an improvement in elevator seats and particularly to a compact elevator seat unit having a low profile and adapted to be disposed between a seat cushion and a seat base of a chair. The lifting mechanism is designed to be contained between the base and the seat panels of the unit so that nothing projects outwardly of the unit. The unit is designed to fit into the seat base of any chair and beneath its cushion, thus to convert a conventional chair to an elevator chair. The Gaffney '569 patent is designed so that no part of the elevator chair unit needs be built into the chair. The device includes an electrical motor driving belts and sheaves as part of the power source of the operating mechanism.

The McKee U.S. Pat. No. 3,596,991 provides an arm chair including hydraulically controlled seat and arms whereby a forward and upward pivoting of the arms and seat can be effected so as to raise an occupant from the chair. Alternatively, the seat in conjunction with a supporting base and the back of the chair can pivot rearwardly so as to assume a partially reclining position with a footrest, through an appropriate linkage, extending to assume a leg supporting position.

The Hodge U.S. Pat. No. 3,640,566 entitled "Invalid Chair" provides a seat back hinged to the back of the seat and a lower frame hinged to the front of the seat to form an extensible assembly which is pivoted to a main support frame, the seat being spring loaded in a direction to extend the assembly of frames so that an invalid is assisted from the seat to his feet, the assembly also being positionable in a recumbent position so that the chair functions as a bed.

The Horstmann U.S. Pat. No. 3,851,917 is concerned with invalid chairs for facilitating standing up and sitting down operations by invalids who are normally unable to stand up and sit down without difficulty. The device comprises a chair base, a seat portion, a back rest, linkage interconnecting the chair base, seat portion and back rest, and resilient means to urge the seat portion and back rest to raised positions and thereby assist an occupant in rising from a sitting position. The back rest is connected to the chair base by a quadrilateral linkage including upper and lower links extending forward from the lower part of the back rest to pivots on the chair base, the seat portion being pivoted to the back rest or to the upper link in the vicinity of the junction therebetween and further linkage being provided whereby as the seat portion and back rest are raised by the resilient means, the seat portion pivots to an angular position where its forward end lies upwardly with respect to the upper link and the inclination between the seat portion and backrest is greater than the corresponding inclination with the seat fully forward.

In the Amstutz U.S. Pat. No. 3,881,771 there is provided a convertible chair that can be converted to various configurations by means of parallelogram linkage actuated by a crank which is in turn actuated by a screw operated by a belt and electric motor.

The Gaffney U.S. Pat. No. 4,007,960 provides a reclining elevator chair having a tiltable back, and extendible leg rest, and means for raising the seat and simultaneously titling it forwardly to assist arthritic or other partially disabled persons in leaving the chair. A power-driven ram tilts the back and extends and retracts the leg rest in one mode of operation. In a second mode of operation, the same ram raises the seat and tilts it forwardly. The first mode of operation occurs when the ram is extended beyond the predetermined length. When the ram is equal to the predetermined length, a portion of the mechanism which tilts the back and extends and retracts the leg rest abuts against a portion of the seat frame and transfers the force of the ram from the back and leg rest to the seat.

In the Gaffney U.S. Pat. No. 4,083,599, a lift chair provides a lift base, a seat, and an extensible and retractable power-actuated ram connected between the lift base and seat to selectively raise and lower the seat. One or another accessory base provided with accessories such as a rocker or wheel assembly is also connected to the seat and is positioned to contact the floor before the ram is fully retracted so that the full retraction of the ram lifts the lift base off the floor and transfers the entire weight of the chair to the accessory base. When the ram is extended, the initial extension of the ram reseats the lift base on the floor and lifts the accessory base off the floor, thus transferring the weight of the chair from the accessory base back to the lift base, which supports and stabilizes the chair during the lifting thereof and until the ram is fully retracted again.

All of these prior art, patented mechanisms provide relatively complex linkage between the seat base and the movable seat portion or sub-frame. These complicated mechanisms require high manufacturing costs and thus higher cost to the end user. Additionally, more complicated mechanisms create a potential for higher maintenance which usually accompanies greater complexity.

It is an object of the present invention to provide an elevator chair for invalids wherein a simplified, yet structurally sound and easily operable lift chair apparatus can be provided at lower expense to the end user as compared with comparable lift chairs having complex mechanical linkage.

SUMMARY OF THE PRESENT INVENTION

The present invention provides a simplified yet structurally sound elevator chair apparatus for use with invalids wherein the chair has a base member with a lower ground engaging surface and an upper load transfer surface. The upholstered chair portion of the apparatus provides an upholstered seat, an upholstered back and sides which are upholstered that can include arms. The upholstered chair portion of the apparatus is supported by a sub-frame member that is pivotally attached to the base member with a hinge. The load transfer surfaces of the base member received the sub-frame there upon in an inclined, fully rearwardly position. A power source in the form of an extensible member pivots the sub-frame with respect to the base and upon the hinge between reclining and lifting positions. A portion of the sub-frame is movable to a lowermost position wherein the sub-frame frame supports the chair in the reclined rearward most position.

The apparatus features a hinge that is horizontally positioned, and at the front of both the chair base and the sub-frame.

The base member is preferably rectangularly shaped and the sub-frame has a similar rectangular configuration.

The sides of the base can be in the form of parallel side walls having correspondingly inclined upper load transfer surfaces for receiving the weight of the chair and sub-frame in a lowermost reclining position. In another embodiment, the subframe has an inclined upper surface with the chair seat parallel to the upper surface of the sub-frame.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENTS

Figure 1:
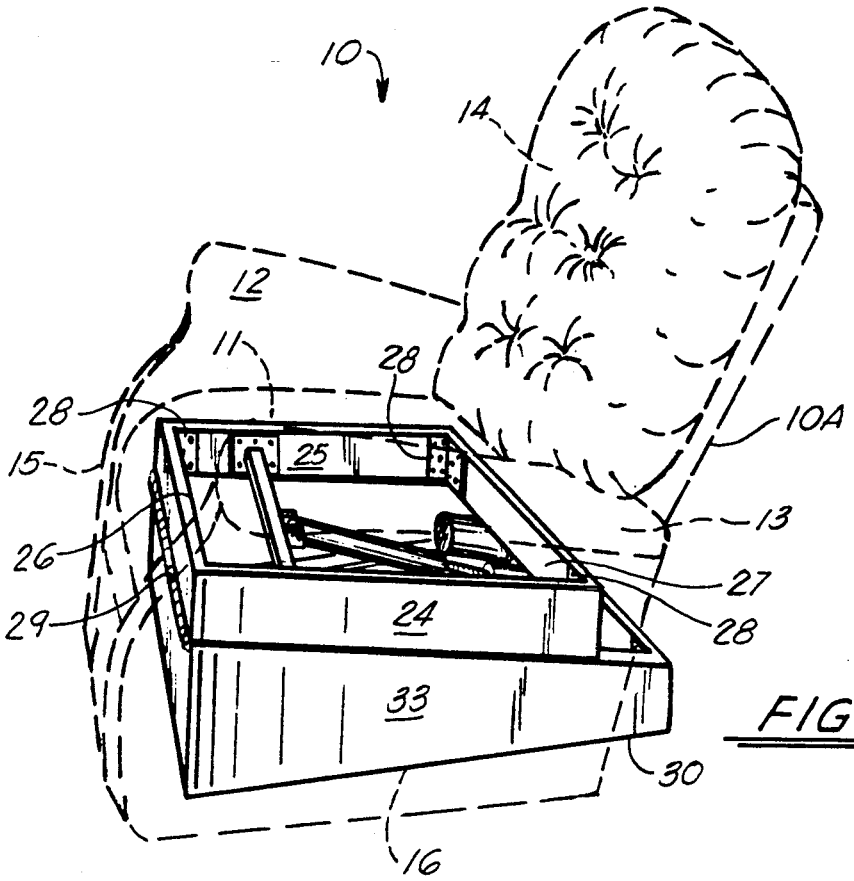
FIG. 1 is a perspective view of the first embodiment of the apparatus of the present invention.

FIGS. 1–6 illustrate a first embodiment of the apparatus of the present invention designated generally by the numeral 10. In FIG. 1, there can be seen lift chair apparatus 10 having an chair portion 10A (such as an upholstered chair portion) with seat 11 portion, spaced apart arms 12, 13 and a back 14. The chair has sides 15, 16 that extend below arms 12, 13 and which terminate at bottom edges 17, 18 rear edges 19, 20 and forward edges 21, 22. The sides 15, 16 can be of wood, covered with foam and fabric for example.

Figure 2:
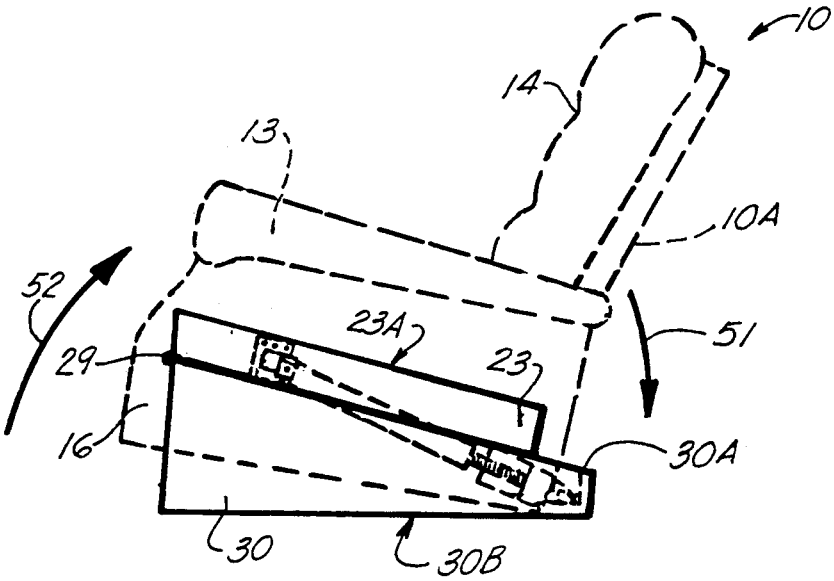
FIG. 2 is a side view of the first embodiment of the apparatus of the present invention shown in a fully reclined, rearward position.
Figure 3:
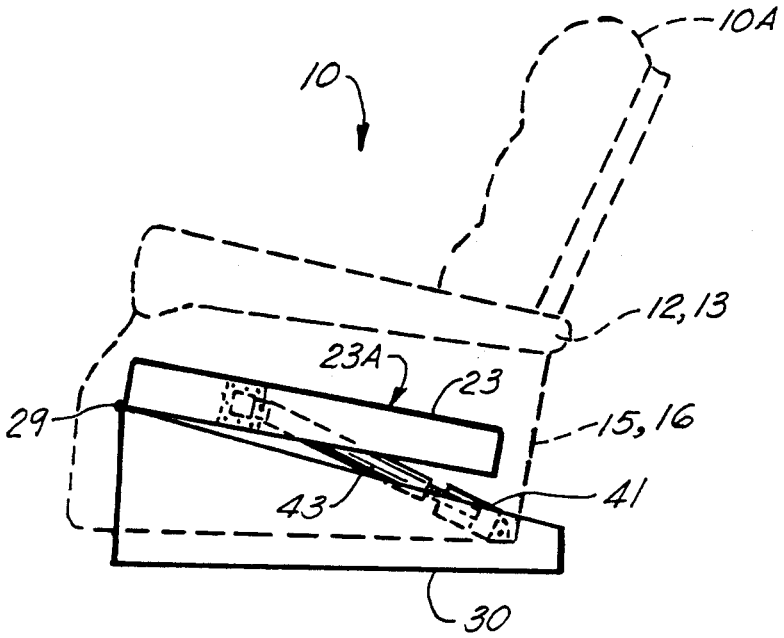
FIG. 3 a side view of the first embodiment of the apparatus of the present invention illustrating a transitional position providing a normal level seating position to the user.

As shown in FIGS. 1–3, the chair portion 10A of lift chair apparatus 10 moves with respect to support base 30 as the chair portion including seat 11; arms 12, 13; back 14 and sides 15, 16 shown in phantom lines in FIGS. 1–5. A sub-frame 23 having top surface 23A and bottom surface 23B, further includes a pair of spaced apart longitudinally extending beams 24, 25 and a pair of spaced apart transverse beams 26, 27 including front transverse beam 26 and rear transverse beam 27. In the first embodiment, the fore and aft beams 26, 27 as well as the side longitudinally extending beams 24, 25 can be of equal height and made of wood, fastened at the ends using metallic L-brackets 28, for example, which can be affixed to the respective beams by using screws, staples, nails or the like.

Base 30 similarly includes front and rear walls 31, 32 and sidewalls 33, 34. The sidewalls 33, 34 provide inclined upper load transfer surfaces 35, 36.

Figure 4:
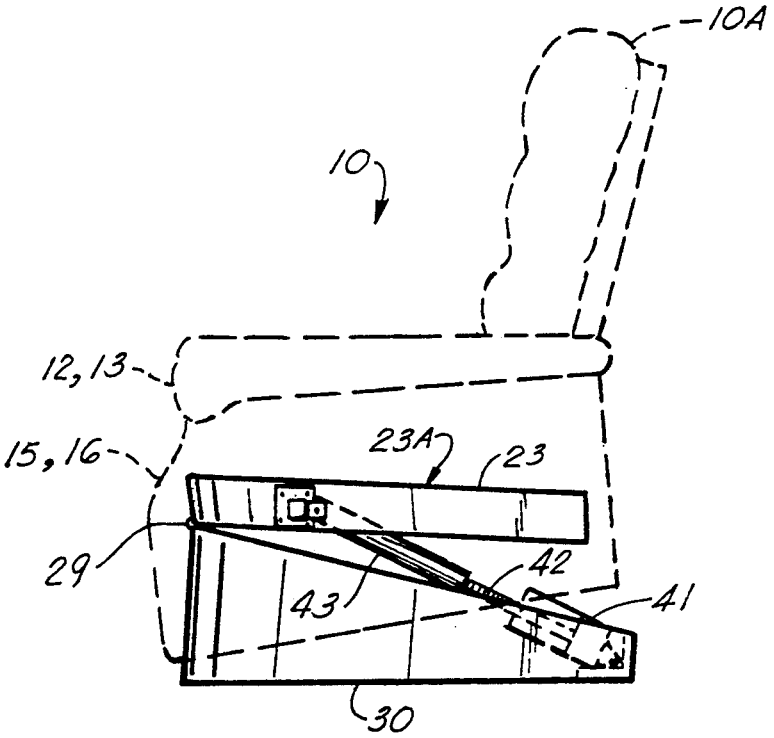
FIG. 4 is a side view of the first embodiment of the apparatus of the present invention illustrating a forwardly tilted seat position prior to full elevation.
Figure 5:
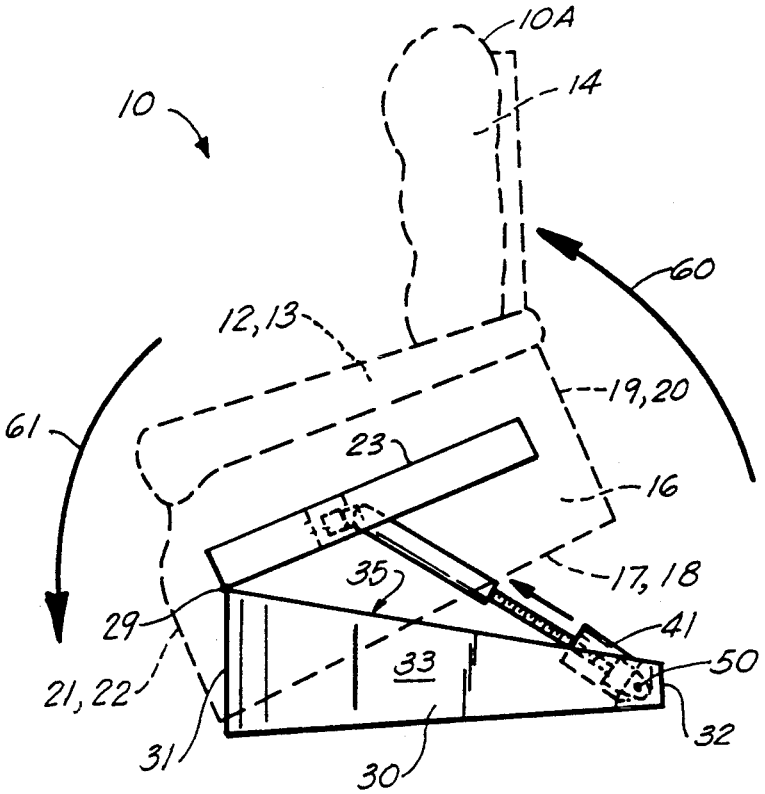
FIG. 5 is a side view of the first embodiment of the apparatus of the present invention illustrating the chair in a maximum forward tilt position to aid the user in moving from a seated to a standing position.

The front wall 31 is thus of equal width but of a greater height than the rear wall 32 as shown in FIGS. 3–5. The sidewalls 33, 34 are of equal length measured fore to aft but are higher in the front and shorter in the back as shown in FIGS. 3–5.

Sub-frame 23 is pivotally attached at pivot or hinge 29 to base 30. The pivot 29 can be a piano hinge for example extending fully across the top of front wall 31, the piano hinge 29 thus being equal to the transverse width of beam 26 and wall 31. In the first embodiment, the sub-frame 23 and the base 30 have equal widths.

The chair portion 10A of lift chair apparatus 10 including seat 11, arms 12, 13, back 14 and sides 15, 16 is structurally attached to and moves with sub-frame 23. Thus, the sides 15, 16 can be attached by bolting, for example to beams 24, 25.

Figure 6:
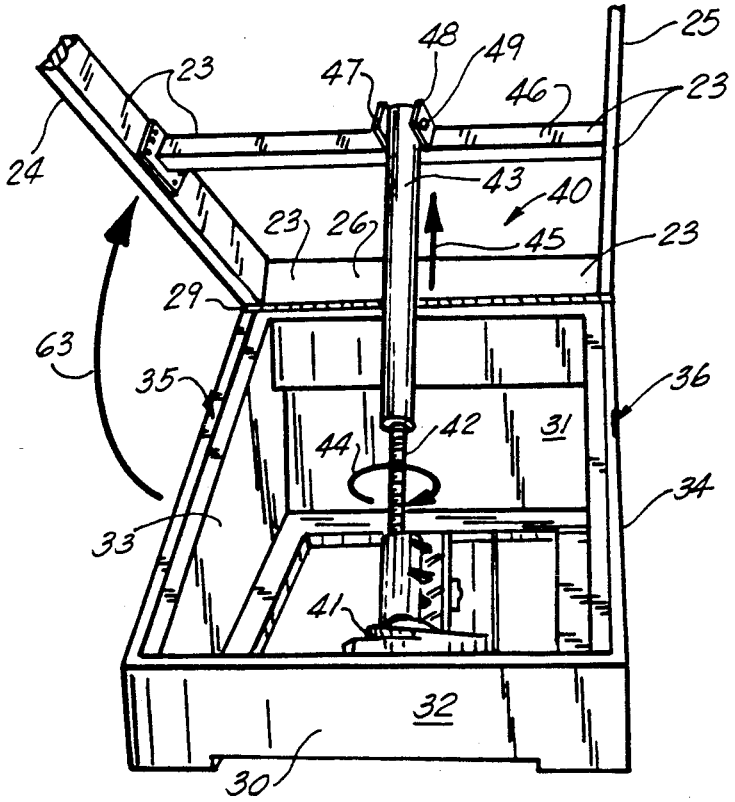
FIG. 6 is a perspective fragmentary view of the first embodiment of the apparatus of the present invention.

A lifting mechanism, designated generally by the numeral 40 in FIG. 6 pivots sub-frame 23 with respect to base 30 and about piano hinge 29. A motor drive 41 can be affixed at pivot 50 to base 30. The motor drive includes a rotating threaded shaft 42 that extends from motor drive 41 upwardly, engaging ram 43. Ram 43 is a tubular sleeve having a longitudinal internally threaded bore. The internal threads of ram 43 engage the external threads of shaft 42 so that when the threaded shaft 42 is rotated as shown by the arrow 44 in FIG. 6, the ram 43 moves away from the motor drive 41 as shown by the arrow 45 in FIG. 6 extending the sub-frame 23 upwardly and pivotally about piano hinge 29.

A transverse beam 46 defines an attachment between ram 43 and sub-frame 23. Gusset plates 47, 48 extend rearwardly from transverse beam 46 with pivot pin 49 forming a pinned or pivotal connection between the ram 43 and the gussets 47, 48. Beam 46 can be attached at its end portions to beams 24, 25 by screws, nails, rivets or staples, for example.

In FIG. 2, a fully reclined position of lift chair apparatus 10 is illustrated wherein the curved arrows 51, 52 show a fully rearwardly rotated position of sub-frame 23 with respect to base 30. In the fully reclined position, the sub-frame 23 has collapsed upon the base 30 so that the lower surfaces of sub-frame 23 have registered upon the upper surface of sub-frame 30. The sub-frame 23 and the base 30 are sized so that upon registration of the sub-frame 23 upon the base 30, the beams 24, 25 rest upon and are supported by the sidewalls 33, 34 of the base 30. The upper inclined surfaces 35, 36 of the sidewalls 33, 34 become bearing surfaces for receiving the beams 24, 25 of the sub-frame 23 in the reclined position.

Notice from an inspection of FIG. 2 that the bottom surface 30A of base 30 defines the lowermost surface of the chair apparatus 10 which engages an underlying horizontal surface such as a floor. Because the upper surfaces 35, 36 are inclined, the sub-frame 23 assumes the same inclination as the inclination of the upper surfaces 35, 36 of the base frame 30 sidewalls 33, 34. The degree of inclination of the chair seat 11 is thus defined by the degree of inclination of the surfaces 35, 36. This allows the manufacturer to design a desired degree of inclination of the chair seat 11 and of back 14 into the chair based upon the users desires or needs. The angle of the back 14 with respect to the seat 11 can be selected during manufacture. Further, the sub-frame 23 preferably comprises beams 24, 25, 26, 27 of equal thickness so that the angle of inclination of the top 23A of sub-frame 23 is equal to the angle of inclination of the surfaces 35, 36.

The upholstered seat 11 preferably is of the same angle of inclination as the upper surface 23A of the sub-frame 23. This allows the angle of inclination of the surfaces 35, 36 and of the top 23A of sub-frame 23 to also define the angle of inclination of the upholstered seat 11.

In FIG. 3, a transitional position is illustrated wherein the ram 43 and threaded rod 42 and motor drive 41 support the upholstered portion of the chair in an intermediate or level position which is comparable to a normal fixed chair in that the seat is at or about horizontal.

In FIG. 4, a slightly lifted position is illustrated which would be a position that the chair seat 11 assumes as the user is partially moving toward a lifted position. In FIGS. 5 and 6, a fully lifted position is illustrated as shown by the arrows 60, 61 in FIG. 5 and the arrow 63 in FIG. 6. This position allows the user to easily stand as the seat 11 has been inclined forwardly and upwardly to assist the user in assuming the standing position.

Figure 7:
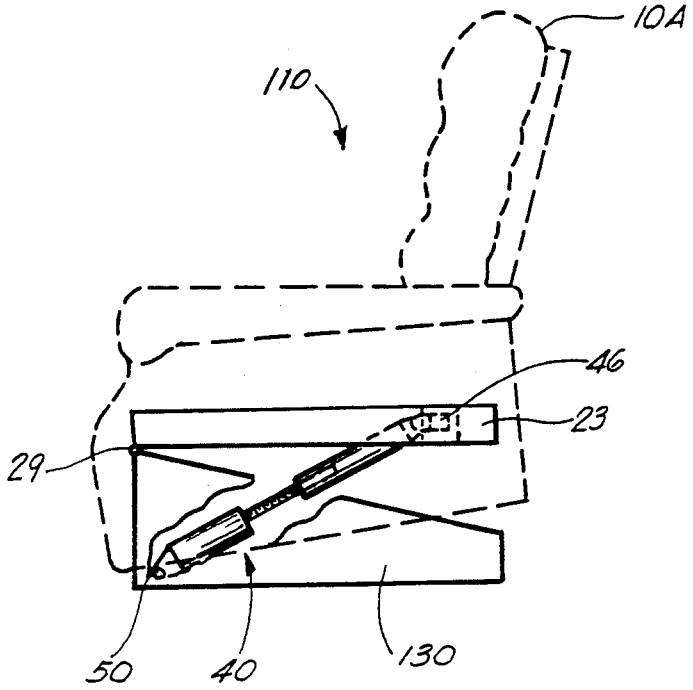
FIG. 7 is a side view of the preferred embodiment of the apparatus of the present invention illustrating a forwardly tilted seat position prior to full elevation.

FIG. 7 is a side view of the preferred embodiment of the apparatus of the present invention, lift chair apparatus 110, illustrating a forwardly tilted seat position prior to full elevation. As with lift chair apparatus 10, the lift chair apparatus 110 includes a chair portion 10A.

Lifting mechanism 40 pivots sub-frame 23 with respect to base 130 and about piano hinge 29. Base 130 is similar to base 30 but is slightly shorter, as seen in FIG. 7. Base 130 can be made shorter than base 30 because lifting mechanism 40 is attached to the front of base 130 rather than the rear as with the embodiment of FIGS. 106. In the embodiment of FIG. 7, lifting mechanism 40 is attached to the rear of sub-frame 23.

Figure 8:
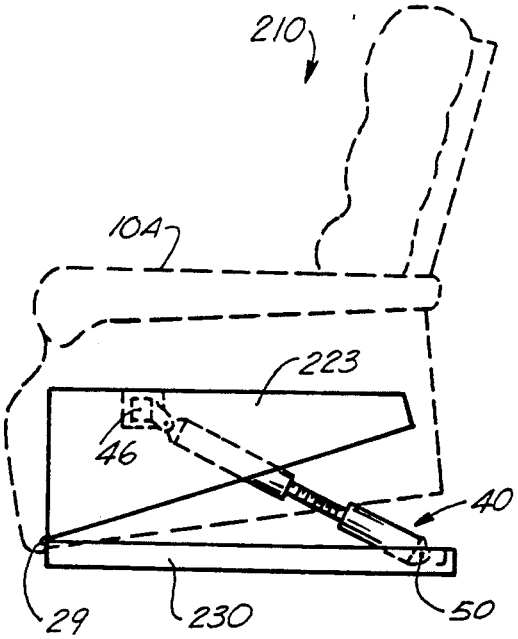
FIG. 8 is a side view of a third embodiment of the apparatus of the present invention illustrating a forwardly tilted seat position prior to full elevation.

FIG. 8 is a side view of the third embodiment of the apparatus of the present invention, lift chair apparatus 210, illustrating a forwardly tilted seat position prior to full elevation. As with lift chair apparatus 10 and lift chair apparatus 110, the lift chair apparatus 210 includes a chair portion 10A.

Apparatus 210 differs from apparatus 10 in that the sub-frame 223 of apparatus 210 more closely resembles support base 30 (turned upside-down) of apparatus 10 than sub-frame 23 of apparatus 10 and in that support base 230 of apparatus 210 more closely resembles sub-frame 23 than support base 30. Lifting mechanism 40 pivots sub-frame 223 with respect to base 230 and about piano hinge 29. In the embodiment of FIG. 8, the pivot 50 is provided at the rear of support base 230 and transverse beam 46 attaches at the front portion of subframe 223.

Figure 9:
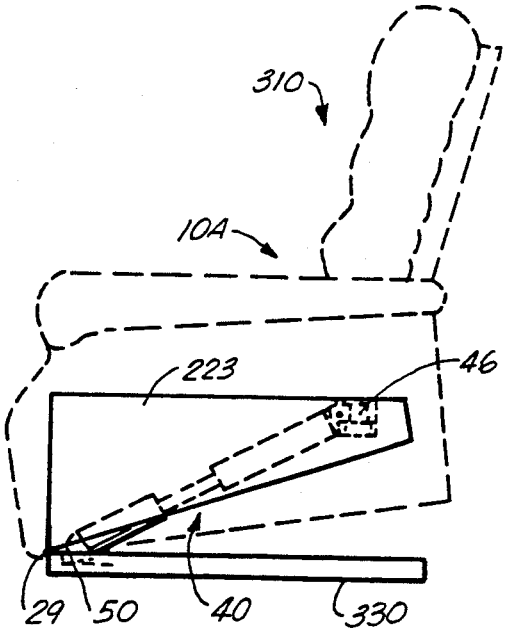
FIG. 9 is a side view of a fourth embodiment of the apparatus of the present invention illustrating a forwardly tilted seat position prior to full elevation.

FIG. 9 is a side view of the fourth embodiment of the apparatus of the present invention, lift chair apparatus 310, illustrating a forwardly tilted seat position prior to full elevation. As with the lift chair 10, 110, and 210, lift chair apparatus 310 includes a chair portion 10A. Apparatus 310 is similar to apparatus 210, but lifting mechanism 40 is attached to the front of base 330 and to the rear of sub-frame 223.

Lifting mechanism 40 pivots sub-frame 223 with respect to base 330 and about piano hinge 29. Base 330 is similar to base 230 but can be slightly shorter, as seen in FIG. 9. Base 330 can be made shorter than base 230 because lifting mechanism 40 is attached to the front of base 330 rather than the rear. Making the base shorter can be advantageous in that chair apparatus 310 takes up less space than apparatus 210. Lifting mechanism 40 is attached to the rear of sub-frame 223. By attaching lifting mechanism to the rear of sub-frame 223, there is more distance between hinge 29 and beam 46, resulting in a longer moment arm and thereby making it easier for mechanism 40 to lift seat portion 10A.

The lifting mechanisms 40 of all embodiments of the present invention are attached to the respective sub-frames and support bases using the hardware shown in FIG. 6.

PARTS LIST

10 lift chair apparatus
10A chair portion
11 seat portion of chair portion 10A
12 arm
13 arm
14 back
15 side of chair portion
16 side of chair portion
17 bottom edge of side
18 bottom edge of side
19 rear edge of side
20 rear edge of side
21 forward edge of side
22 rear edge of side
23 sub-frame
23A top (surface) of sub-frame
23B bottom surface of sub frame
24 longitudinally extending beam
25 longitudinally extending beam
26 front (fore) transverse beam 27 rear (aft) transverse beam
28 metallic L-brackets
29 pivot or hinge
30 support base
30A top surface of base
30B bottom surface of base
31 front wall of support base
32 rear wall of support base
33 sidewall of support base
34 sidewall of support base 30
35 inclined upper load transfer surface
36 inclined upper load transfer surface
40 lifting mechanism
41 motor drive
42 rotating threaded shaft
43 ram (a tubular sleeve having a longitudinal internally threaded bore)
44 arrow
45 arrow
46 transverse beam
47 gusset plate
48 gusset plate
49 pivot pin forming a pinned or pivotal connection between ram 43 and gussets 47, 48
50 pivot
51 curved arrow
52 curved arrow
60 arrow
61 arrow
63 arrow
110 lift chair apparatus
130 support base
210 lift chair apparatus
223 sub-frame
230 support base
310 lift chair apparatus
330 support base 330

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A lift chair apparatus having a chair seat member with an upper seat surface, and a chair back and being movable together between rear, reclining and forward, lifting positions comprising:

a) a base member having front and rear portions, a lower ground engaging surface that defines a first plane, and an upper surface that defines a first mating surface;

b) a sub-frame member comprised of front, rear and side portions for supporting the chair seat and chair back members, and having a second mating surface that can engage the first mating surface;

c) a hinge member defining a single rotation center for the base and sub-frame and having a horizontal elevational position, and affixed to the front end portion of the base member;

d) the sub-frame member being pivotally attached to the base member at the hinge;

e) pivoting means for pivoting the sub-frame member about the hinge and with respect to the base member between reclining and lifting positions;

f) a portion of the sub-frame member being movable to a position wherein the sub-frame member supports the chair seat upper surface in a second plane that forms an acute angle with the first plane and a rearwardly inclined position so that the user reclines; and g) wherein the first and second mating surfaces are engaged in the said inclined position and the engaged mating surfaces defining an acute angle with the first one of the planes.

2. The apparatus of claim 1 wherein the hinge has a horizontal axis of rotation.

3. The apparatus of claim 1 wherein the base member is rectangularly shaped, having four side walls including front, rear, left, and right sides defining a periphery of the base member.

4. The apparatus of claim 1 wherein the pivoting means includes an extensible member connected at one end to the base member and at the other end to the sub-frame member.

5. The apparatus of claim 4 wherein the extensible means attaches to the sub-frame at the rear end portion of the chair.

6. The apparatus of claim 5 wherein the base member has a pair of spaced apart beam members positioned to register upon the parallel sidewalls when the chair is in a fully reclined position.

7. The apparatus of claim 1 wherein the base member includes a plurality of peripheral walls at least two of which are parallel sidewalls.

8. The apparatus of claim 7 wherein the parallel sides have inclined upper surfaces.

9. The apparatus of claim 8 wherein the upper inclined surfaces of the sides are inclined respectively at the same angle of inclination.

10. A lift chair apparatus having seat and back members and comprising:

a) a base member that includes a plurality of peripheral side walls, the top of the side walls defining a first mating surface and a bottom that defines a first plane;

b) a horizontal hinge member affixed to the forward end portion of the base member;

c) a sub-frame member supporting the seat and back members and the seat having an upper surface defining a second plane, and the bottom of the sub-frame defining a second mating surface;

d) the sub-frame member being pivotally attached to the base member at the hinge so that the sub-frame, seat, and back pivot about the hinge as a unit;

e) motor drive means for pivoting the sub-frame member with respect to the base member between reclined lower and elevated lifted positions; and f) the mating surfaces of the sub-frame and base members forming an acute angle with one of the planes when the sub-frame is moved into an inclined position.

11. The apparatus of claim 10 wherein the sub-frame member comprises a generally rectangular member having left and right side walls, each with inclined upper load transfer surfaces and the sub-frame member comprises a rectangular member having left and right side walls and wherein the pivot axis extends to the side walls of both the base frame and the sub-frame.

12. The apparatus of claim 10 wherein the motor drive means includes an extensible member connected at one end portion to the base member and at its opposite end portion to the sub-frame member.

13. The apparatus of claim 10 wherein the motor drive means includes a threaded shaft rotatable by the motor drive, and a ram having a threaded portion for engaging the threaded rod so that rotation of the threaded rod moves the ram away from the motor drive.

14. The apparatus of claim 10 wherein the sub-frame member includes an upper surface that is generally parallel to the surface of the seat.

15. The apparatus of claim 10 wherein the sub-frame member includes a generally rectangular structure having a plurality of four side walls, each of which has a generally uniform height.

16. The apparatus of claim 10 wherein the seat and back members are connected together to move as a unit upon the sub-frame member.

17. The apparatus of claim 10 wherein the hinge member extends in a transverse direction substantially across the base member.

18. The apparatus of claim 10 wherein the pivoting 2 means attaches at one end portion to the front of the base member.

19. The apparatus of claim 10 wherein the pivoting means connects at one end portion to the sub-frame member at the mid-portion thereof in a longitudinal direction.

20. The apparatus of claim 10 wherein the sub-frame member comprises a plurality of walls including forward and aft walls and a pair of side walls, and there is further provided an intermediate beam member extending transversely across the sub-frame member and the pivoting means attaches at one end portion to the intermediate beam.

21. The apparatus of claim 10 wherein the means for pivoting attaches to the sub-frame member at a position that is at the center of the sub-frame member in both fore aft and side to side directions.

22. The apparatus of claims 1 or 10 wherein the base has side walls that are in the shape of a trapezoid.

23. The apparatus of claims 1 or 10 wherein the sub-frame has side walls that are in the shape of a trapezoid.

* * * * *